United States Patent [19]

Pospíšil et al.

[11] 4,083,507

[45] Apr. 11, 1978

[54] GROOVED, YARN-DISTRIBUTING TRAVERSING CYLINDERS IN TEXTILE MACHINES

[75] Inventors: František Pospíšil; Stanislav Škoda; Stanislav Ešner; Miroslav Tyl, all of Usti nad Orlici; Karel Mikulecký, Chocen; Miloslav Jiskra, Usti nad Orlici, all of Czechoslovakia

[73] Assignee: Vyzkumny ustav bavlnarsky, Usti nad Orlici, Czechoslovakia

[21] Appl. No.: 728,838

[22] Filed: Oct. 1, 1976

[30] Foreign Application Priority Data

Oct. 3, 1975 Czechoslovakia ..... 6706/75

[51] Int. Cl.[2] ..... B65H 54/48

[52] U.S. Cl. ..... 242/43.2

[58] Field of Search ..... 242/43.2, 18 DD

[56] References Cited

U.S. PATENT DOCUMENTS

| | | | |
|---|---|---|---|
| 2,004,153 | 6/1935 | Brainard | 242/18 DD |
| 2,231,837 | 2/1941 | Elvin et al. | 242/18 DD |
| 2,646,227 | 7/1953 | Calhoun et al. | 242/43.2 |
| 3,092,339 | 6/1963 | Hill et al. | 242/18 DD |
| 3,128,957 | 4/1964 | Fallscheer | 242/43.2 |
| 3,291,405 | 12/1966 | O'Brien | 242/18 DD |
| 3,393,879 | 7/1968 | O'Brien | 242/43.2 X |

FOREIGN PATENT DOCUMENTS

| | | | |
|---|---|---|---|
| 1,144,163 | 2/1963 | Germany | 242/18 DD |
| 1,175,588 | 8/1964 | Germany | 242/43.2 |

*Primary Examiner*—Harvey C. Hornsby
*Assistant Examiner*—John M. Jillions

[57] ABSTRACT

An improved construction of a rotary yarn-distributing cylinder cooperable with a yarn take-up bobbin at the output of an open-end spinning machine or similar textile apparatus is described. The major portion of the periphery of the distributing cylinder is formed by or covered with a smooth material having a high coefficient of friction to promote efficient driving engagement with the adjacent bobbin. The boundaries of the first surface region are separated from the respective edges of the inclined distributing grooves on the cylinder periphery by second surface regions in the form of smooth strips. The strips exhibit a coefficient of friction considerably lower than the coefficient of the material of the first surface region to permit smooth and unretarded payoff of the yarn in the grooves to the bobbin as the cylinder rotates.

7 Claims, 2 Drawing Figures

GROOVED, YARN-DISTRIBUTING TRAVERSING CYLINDERS IN TEXTILE MACHINES

BACKGROUND OF THE INVENTION

The invention relates to cylinders having inclined grooves on the periphery thereof for paying off yarn from a textile machine onto an adjacent take-up bobbin that is frictionally coupled to the cylinder.

Conventionally, yarn exiting from the spinning chamber of an open-end spinning machine is received by a helical or other inclined groove on the surface of the distributing cylinder, which pays off the yarn across the surface of the bobbin in interleaved-spool fashion when the cylinder is rotated. During the rotation of the cylinder, frictional engagement maintained between the adjacent peripheries of the cylinder and the bobbin cause the bobbin to rotate so that the yarn is evenly distributed thereon.

In known designs of this type, the required frictional driving engagement between the cylinder and the bobbin is effected by roughening the peripheral surface of the cylinder. Such arrangements have several disadvantages, particularly during high-speed operation of the spinning machine. For example, because of the roughened periphery adjacent the cylinder grooves, the yarn exiting from the grooves toward the bobbin is susceptible to tearing and other damage.

In addition, the roughening of the cylinder surface has been found to effect a variation in yarn tension at different points along the path of of distribution of the yarn. As a result, either the yarn is subject to local slackening, or, if such slackening is compensated, other portions of the yarn are subjected to excess tension and strain.

Furthermore, the roughness of the surface of the cylinder in such designs tends to gradually diminish with time by abrasion and the like, thereby causing a corresponding loss in frictional driving torque on the driven take-up bobbin.

SUMMARY OF THE INVENTION

All of such disadvantages are overcome with the use of the improved distributing cylinder construction of the present invention. In an illustrative embodiment, a major portion of the surface of the cylinder is coated with a smooth, highly frictional surface such as rubber or cork. The boundaries of the high-friction region are disposed in spaced relation to the edges of the helical distributing grooves, thereby defining, on the surface of the cylinder periphery, second surface regions in the form of strips that extend along the associated grooves.

The strips exhibit a coefficient of friction significantly less than that of the first surface region, and are made smooth in order to permit easy and uninterrupted payout of yarn from the grooves onto the adjacent bobbin. At the same time, the smooth nature of the surface regions on the cylinder are not susceptible to the abrasion which characterized the roughened cylinders of the prior art.

BRIEF DESCRIPTION OF THE DRAWING

The invention is further set forth in the following detailed description taken in conjunction with the appended drawing, in which.

DETAILED DESCRIPTION

Figure 1:
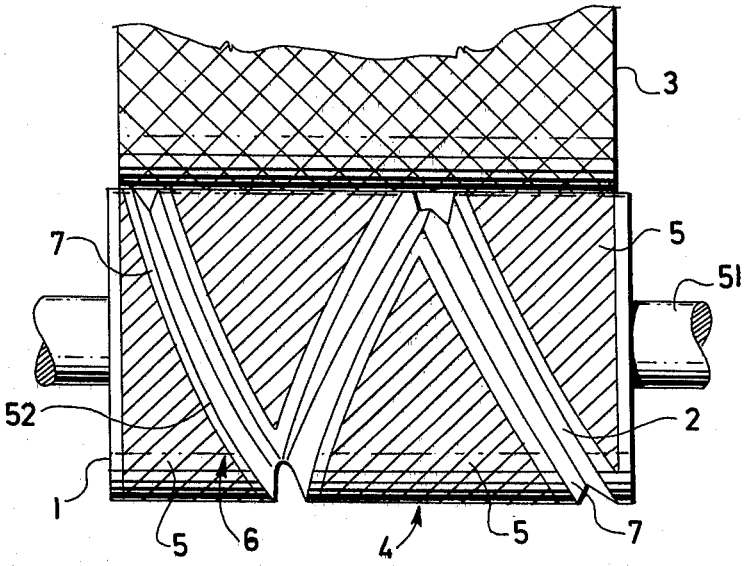
FIG. 1 is an axial view of a yarn distributing cylinder constructed in accordance with the invention, exhibiting a first configuration of high-coefficient smooth coating on the surface thereon.

Referring now to the drawing, there is depicted a grooved distributing cylinder 1 of the general type associated with an open-end spinning machine (not shown) or similar textile apparatus. In particular, spun yarn (not shown) from the textile machine is routed to the cylinder 1 and is wound around a system of helical or similarly inclined distributing grooves 2 disposed along the periphery of the cylinder 1.

In a conventional manner, the cylinder 1 is supported for rotation on a shaft 51. A yarn take-up bobbin 3 of conventional construction is drivingly coupled to the periphery of the distributing cylinder 1, whereby the rotation of the cylinder 1 will cause yarn disposed in the grooves 2 of the cylinder to be paid out in roving fashion on the surface of the bobbin 3 to define a finished yarn package.

In accordance with the invention, the required frictional driving engagement between the periphery of the cylinder 1 and the bobbin 3 is provided for by forming first surface regions 5 of the cylinder periphery from a smooth material having a relatively high coefficient of friction, e.g., in the range of 0.3 – 1.0. The surface regions 5, which as indicated form the major portion of the peripheral surface, have boundaries 6 which are disposed in spaced relation to respective boundary edges 52 of the distributing grooves 2 to define therebetween a plurality of second surface regions 7. The regions 7 collectively occupy, in the embodiment of FIG. 1, relatively small portions of the peripheral surface.

The regions 7, which like the high-friction regions 5 are smooth in texture, have a coefficient of friction which is significantly lower than that of the surface regions 5. Typically, the coefficients of friction of the regions 7 may be in the range of 0 – 0.2.

The width of the regions 7, which as shown may be in the form of strips that extend along the boundary edges 52 of the adjacent grooves 2, are chosen wide enough to isolate the yarn exiting from the grooves 2 from the high-friction regions 5. As an example, where the diameter of the cylinder 1 is 80 mm and the width of each groove 2 is 15 mm, the width of the strips 7 is advantageously in the range of 3 – 5 mm; the upper limit may be extended somewhat, of course, when unusually coarse yarns are being processed.

Advantageously, the high-friction surface regions 5 may be formed by coating coextensive portions of an underlying smooth, low-friction periphery of the cylinder 1 with a suitable high-friction material, such as rubber or cork. In the former case, a spray-coating operation may be used. In such case, suitable base materials for the wall of the cylinder may be steel or bakelite.

As an alternative to coating discrete areas of the surface as shown in FIG. 1, the entire periphery outside the grooves 2 may be initially sprayed or otherwise coated, after which the regions forming the low-friction strips 7 may be ground or otherwise abraded from the main coating to yield the configuration shown in FIG. 1.

Figure 2:
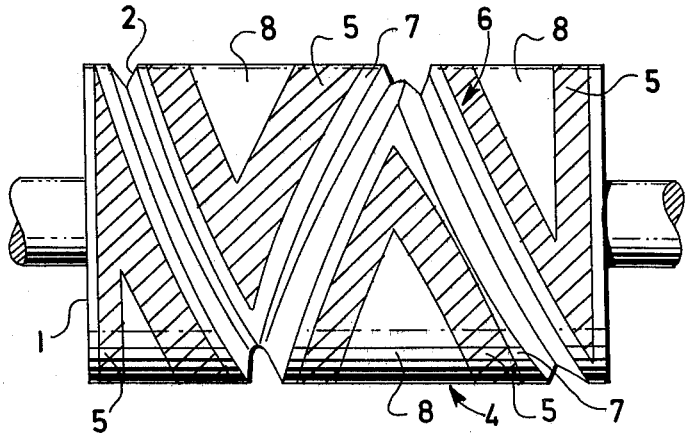
FIG. 2 is an axial view of a distributing cylinder similar to FIG. 1 but having a somewhat different configuration of high-friction coating on its periphery.

An alternative configuration of the surface regions 5 is depicted in FIG. 2. The arrangement of FIG. 2 differs from FIG. 1 only by the provision, in central areas of each of the surface regions 5, of low-friction cutouts 8, which are smooth and which may exhibit the same low coefficient of friction as the strips 7. In a manner analogous to that suggested above, each of the low-friction regions 8, like the strips 7, may be defined on the base surface of the cylinder periphery after the entire periphery thereof is sprayed or coated with high-friction material.

In the foregoing, some illustrative arrangements of the invention have been described. Many variations and modifications will now occur to those skilled in the art. It is accordingly desired that the scope of the appended claims not be limited to the specific disclosure herein contained.

What is claimed is:

1. In a textile machine having a yarn take-up bobbin and a rotatable distributing cylinder having a periphery disposed adjacent and in frictional driving relation to the bobbin, the cylinder exhibiting at least one helical distributing groove disposed along the periphery thereof for paying yarn onto the bobbin while the bobbin is driven by the cylinder, the improvement wherein the periphery of the cylinder exhibits a first relatively large smooth surface region having a first relatively large coefficient of friction, the boundaries of the first surface region being spaced from each peripheral wall of each distributing groove on the cylinder to define therebetween a second smooth, relatively small surface region on the periphery of the cylinder for isolating yarn exiting from the grooves from the first surface region, the second surface region having a second coefficient of friction substantially smaller than the first coefficient of friction.

2. The improvement as defined in claim 1, in which the first coefficient of friction has a value in the range of 0.3 – 1.0.

3. The improvement as defined in claim 1, in which the second coefficient of friction has a value in the range of 0 – 0.2.

4. The improvement as defined in claim 1, in which each second region is in the form of an helical strip corresponding and extending parallel to the adjacent groove.

5. The improvement as defined in claim 1, in which the first surface region is defined by a coating of a smooth first material on a portion of the outer surface of the cylinder coextensive with the first surface region, the first material having the first coefficient of friction.

6. The improvement as defined in claim 5, in which the first material is rubber.

7. The improvement as defined in claim 5, in which the first material is cork.

* * * * *